US009762035B2

(12) United States Patent
Westebbe et al.

(10) Patent No.: US 9,762,035 B2
(45) Date of Patent: Sep. 12, 2017

(54) MULTI-STEP TUBE OF A CERAMIC MATERIAL AND GAS DISCHARGE TUBE MADE OF THE SAME

(75) Inventors: Thomas Westebbe, Berlin (DE); Yu Zhang, Xiaogan Hubei (CN); Eric Liu, Xiaogan Hubei (CN); Jiaping Hong, Xiaogan Hubei (CN)

(73) Assignee: EPCOS AG, Munic (DE)

( * ) Notice: Subject to any disclaimer, the term of this patent is extended or adjusted under 35 U.S.C. 154(b) by 652 days.

(21) Appl. No.: 14/346,302

(22) PCT Filed: Dec. 6, 2011

(86) PCT No.: PCT/EP2011/071931

§ 371 (c)(1),
(2), (4) Date: Jun. 12, 2014

(87) PCT Pub. No.: WO2013/041150

PCT Pub. Date: Mar. 28, 2013

(65) Prior Publication Data

US 2014/0327996 A1 Nov. 6, 2014

(30) Foreign Application Priority Data

Sep. 24, 2011 (CN) ..... 2011 1 0286062
Sep. 24, 2011 (CN) ..... 2011 2 0360365 U

(51) Int. Cl.

| | |
|---|---|
| ***H01T 4/08*** | (2006.01) |
| ***H01T 4/10*** | (2006.01) |
| ***H01T 4/12*** | (2006.01) |
| ***H01T 4/16*** | (2006.01) |
| ***H01T 4/20*** | (2006.01) |

(52) U.S. Cl.
CPC ..... *H01T 4/12* (2013.01); *H01T 4/16* (2013.01); *H01T 4/20* (2013.01)

(58) Field of Classification Search
CPC ..... H01T 4/08; H01T 4/10; H01T 4/12
USPC ..... 361/120
See application file for complete search history.

(56) References Cited

U.S. PATENT DOCUMENTS

2009/0102377 A1* 4/2009 Schleimann-Jensen .. H01T 4/12 313/567

FOREIGN PATENT DOCUMENTS

| | | |
|---|---|---|
| EP | 1075064 A1 | 2/2001 |
| WO | 2009/049463 A1 | 4/2009 |

* cited by examiner

*Primary Examiner* — Dharti Patel
(74) *Attorney, Agent, or Firm* — McDermott Will & Emery LLP

(57) ABSTRACT

A multi-step tube (1) of a ceramic material comprises a tube body (1) of the ceramic material having an inner wall (11) located inside the tube body (1). A surface of the inner wall (11) is formed with a plurality of steps (2). The steps (2) are formed to extend differently far inside the tube (1). A multi-layered gas discharge tube comprises the multi-step tube (1). An inner electrode (31) is disposed on a step (21), and an outer electrode (41) is disposed on an outer surface (13) of the tube body (1). A disc (51) is partially placed on a step (22) and the inner electrode (31) between the inner electrode (31) and the outer electrode (41) so that, in case of an electrostatic discharge, the discharge will only take place in the center of the multi-step tube (1) and not at the border of the isolated ceramic disc (51).

9 Claims, 2 Drawing Sheets

MULTI-STEP TUBE OF A CERAMIC MATERIAL AND GAS DISCHARGE TUBE MADE OF THE SAME

TECHNICAL FIELD

The present invention relates to a gas discharge tube applicable to lightning protection for a power supply system.

The application claims priority to Chinese Invention Patent Application No. 20110286062 which is incorporated herein by reference in its entirety.

BACKGROUND

Currently reported lightning surges are about two times in amounts more than those occurred a decade ago. It becomes more and more important to prevent people and electric apparatuses from voltage surge. In this field, in addition to human life protection, more technical solutions have centralized on ensuring good and continuous operation of electric apparatuses. In accordance with lightning protection zone principle of VDE V 0185 Part 4, IEC 61643-11 stipulates specifications for sub-distribution network (Grade II) and terminals (Grade III), as well as gas discharge tubes at building entrances (Grade I).

The gas discharge tubes have been widely used for protection of electric apparatuses, sub-distribution networks and NPE (Neutral Protective Earth) at the building entrances. Since L-N (Phase-Neutral) protection at the building entrances requires high follow-current capacity of a product, the Grade I L-N protection usually uses, heretofore, conventional air sparks gaps with triggering devices, which are basically suitable for the use with high currents and voltages, but are cumbersome, expensive and voluminous.

Air gaps have mainly the following defects:

1. Voltage protection level is higher than 3000V.
2. The performance thereof is unstable during its life service life, and the open gap is susceptible to climatic environment and contamination.
3. Explosive flames or shock waves could occur during operation.
4. There is a requirement to keep installing distances thereof from nearby appliances or devices.
5. Additional trigger lines are required and arcs are extinguished by means of an auxiliary device.

In order to overcome the defect of insufficient open air gaps possible technical solution in relation to a closed gas discharge tube is to connect a plurality of gas discharge tubes in series so as to increase an arc voltage, thereby intercepting the follow current. If it is assumed that a single-layered arc voltage is only about 18V (in accordance with the gas discharge principle), 15 single-layered gas discharge tubes are necessary to be connected in series to achieve 270V arc voltage, which cannot meet market demands from the aspects of cost and volume.

To this end, some products use a single-layered gas discharge tube with multi-layered discharge gaps therein to increase the arc voltage, so as to reduce the cost and volume of the product. However, the defect of a lateral discharge between gaps cannot be avoided, and there is a limitation in enhancement of arc voltage and follow-current capacity, such that said products fail to be widely used.

There is a desire to provide a tube of a ceramic material which may be used as a gas discharge tube wherein the electric discharge occur in the center of the tube. Another desire is to provide a multi-layered gas discharge tube made of such a multi-step tube, which has the advantages of high arc voltage, high follow-current capacity, stable performance, small volume and easy installation.

SUMMARY

According to an embodiment of a multi-step tube of a ceramic material, the multi-step tube comprises a tube body of the ceramic material having an inner wall located inside the tube body, a surface of the inner wall being formed with a plurality of steps, and the steps being formed to extend differently far inside the tube.

A multi-layered gas discharge tube comprising the multi-step tube as defined above is provided. The multi-layered gas discharge tube further comprises a first electrode being disposed on a first side of a first step of the tube body, a second electrode being disposed on a first one of outer surfaces of the tube body, and a first isolated ceramic disc being disposed between the first electrode and the second electrode.

The gas discharge tube is formed of said multi-step ceramic tube. Since the ceramic tube with a multi-step structure therein is used, the creepage distance between the gaps is effectively increased so that marginal discharges along the ceramic wall between the gaps can be avoided. The providing of three independent discharge gaps in a single-layered discharge tube enables that the arc voltage can be increased by several times, so that, for example, the arc voltage of a single layer may reach 65V, and the follow-current capacity is greatly enhanced.

The ceramic tube with a multi-step structure therein is used to ensure that a single-layered discharge tube has a plurality of independent discharge gaps therein and discharges from a main gap under large current flow. In normal conditions, the discharge tube is used for power supply L-N protection. In addition to undergoing direct lighting (10/350 us wave simulation) surge, a main requirement of the discharge tube is that it must be capable of effectively intercepting the follow current, and/or tripping of the 32 A fuse as required by safety standards.

This means that the technical solution regarding the discharge tube must have a sufficiently high arc voltage (270V). A single-layered discharge tube may have an arc voltage of about 18V only. Therefore, in order to achieve such a high arc voltage (270V), at least 15 single-layered gas discharge tubes must be connected in series, which is, however, not allowed in terms of cost and installing space.

The technical solution of the gas discharge tube has three layers of movable discharge gaps without changing the volume of the single-layered gas discharge tube, such that the arc voltage of the single-layered discharge tube can be increased about 4 times. A discharge tube comprising 4 layers thereof is sufficient to solve the problems of the follow current and fuse trip, thereby making it possible that the discharge tube is used for power supply L-N protection, and this type of discharge tube has great advantages in reliability, cost and performance.

BRIEF DESCRIPTION OF THE DRAWINGS

Embodiments of the multi-step tube and the multi-layered gas discharge tubewill be further described and explained in conjunction with the following, accompanied drawings, in which.

DETAILED DESCRIPTION

Figure 3:
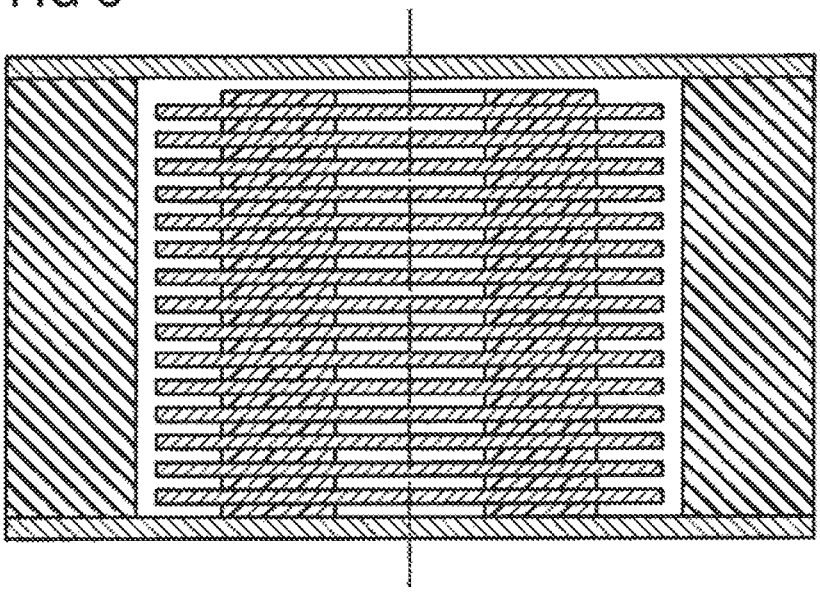
FIGS. 3 and 4 show schematic structural views of other embodiments of gas discharge tubes.

A first embodiment of a gas discharge tube has an internal structure as shown in FIG. 3, wherein there are 16 discharge gaps in the intermediate discharge tube. However, it has only 48V arc voltage and discharges laterally with a large current flow, which causes failure due to heating and melting of the edges of the built-in electrode sheets.

Figure 4:
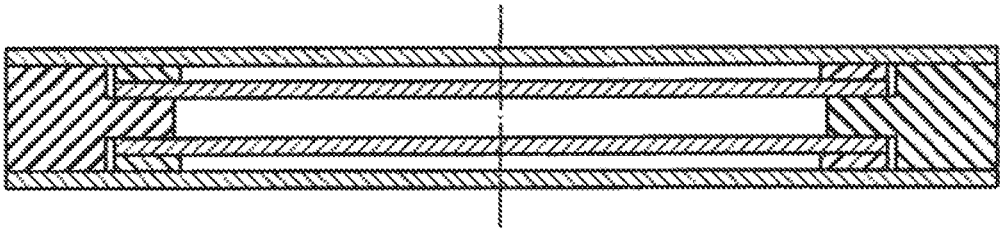

A second embodiment of a gas discharge tube has an internal structure as shown in FIG. 4, wherein a single-layered discharge tube has three discharge gaps therein; however, it has only 42V arc voltage and an intermediate gap discharges from an intermediate portion with large current flow whereas the other two gaps discharge from the edges (lateral sides) of the electrodes due to insufficient creepage distance, which causes failure due to heating and melting of the edges of built-in electrode sheets.

Figure 1:
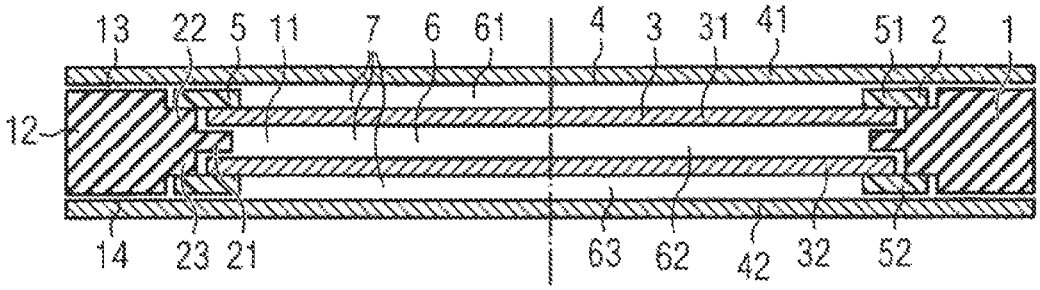
FIG. 1 shows a schematic structural view of an embodiment of a multi-layered gas discharge tube.

As shown in FIG. 1, a multi-step ceramic tube comprises a ceramic tube body 1 provided with a plurality of steps 2 therein. The tube body 1 of the ceramic material comprises an inner wall 11 located inside the tube body 1. A surface of the inner wall 11 comprises the plurality of steps 2. The steps are formed as noses or projections in the inner wall. The steps 2 are formed in the surface in such a way that they extend differently far inside the tube. The steps 2 of the tube 1 comprise a step 21, a step 22 and a step 23. The step 21 is arranged between the step 22 and the step 23. The step 21 may extend more far inside the tube 1 than the step 22 and the step 23.

The multi-step tube comprises an outer wall 12 and outer surfaces 13, 14 of the tube body 1. Each of the outer surfaces 13, 14 is located between the outer and the inner wall 11, 12 of the tube body 1. The outer surfaces 12, 13 have a larger area than a surface of each of the steps 2.

A multi-layered gas discharge tube, as shown in FIG. 1, comprises the multi-step tube with the plurality of steps as explained above. The discharge tube further comprises inner electrodes 3 disposed on the steps inside the tube body and outer electrodes 4 disposed on the surfaces 12, 13 at the end of the tube body 1. The inner electrodes are separated from the outer electrodes by a respective disc 5 which may be made of a ceramic material. The isolated ceramic disc 5 may be formed as a ring-shaped spacer having a hollow area between the ring-shaped zone. The inner and outer electrodes 3, 4 just bear on the disc 5 at their rims. The inner and outer electrodes are separated from each other in areas between their rims so that hollow chambers 6 may be formed between the electrodes 3 and 4.

According to the embodiment shown in FIG. 1, the inner electrodes 3 comprise an electrode 31 being disposed on a first side of the step 21 of the tube body 1. The electrode 31 may be formed as an electrode disc. The rim of the electrode 31 is disposed on the protrusion 11 of the tube body 1. The outer electrodes 4 comprise an electrode 41 which is disposed on the outer surface 13 of the tube body to close the tube body 1. The electrode 41 may be circular-shaped. The electrode 41 and the electrode 31 are separated by the disc 51 which may be made of an isolated ceramic material. The isolated ceramic disc 51 is disposed between the electrode 31 and the electrode 41. Since the disc 51 is formed as a ring with a hollow inner area, a chamber 61 is formed between the inner electrode 31 and the outer electrode 41.

The isolated ceramic disc 51 is shifted in relation to the inner electrode 31 and the outer electrode 41. The disc 51 may be disposed partially on the electrode 31 and on the step 22 of the tube body 1. A gap which may be formed between the tube body 1 at the end of the protrusion 22 and the electrode 31 is covered by the disc 51 so that the disc 51 blocks a path along the inner wall of the tube body 1 between the inner electrode 31 and the outer electrode 41.

The multi-layered gas discharge tube may comprise another inner electrode 32 being disposed on a second side of the step 21 of the tube body 1. The outer electrodes 4 comprise another outer electrode 42 formed at the other end of the tube body. The outer electrode 42 is disposed on the outer surface 14 of the tube body and closes the tube body at the lower side. A disc 52 which may be made of ceramic material is arranged between the electrode 32 and the outer electrode 42. The isolated ceramic disc 52 is formed in a ring-shaped manner so that only the rim of the inner electrode is supported by the ceramic disc 52. The disc 52 acts as a spacer between the inner electrode 32 and the outer electrode 42 so that another chamber 62 is formed between the inner electrode 32 and the outer electrode 42. The inner electrode 32 and the outer electrode 42 are separated from each other by a hollow area forming chamber 62 there between.

The disc 52 is shifted in relation to the inner electrode 32 and the outer electrode 42 and is partially disposed on the step 23 and on the electrode 32. A gap which may be formed between the electrode 32 and the tube body 1 is covered by the disc 52 so that the disc 52 blocks a path between the inner electrode 32 and the outer electrode 42.

The protrusion 21 is arranged between the inner electrodes 31 and 32. The projection 21 extends from all sides in the interior of the tube to an amount so that the electrodes 31 and 32 just bear on their rim onto the nose 21. The nose 21 is formed so that another hollow chamber 63 is formed between the inner electrodes 31 and 32. The electrodes 31 and 32 and the tube body 1, i.e. the step 21 of the tube body, form chamber 63.

The chambers 61, 62 and 63 are filled with a mixture of inert and non-inert gases. The chambers form three layers of discharge gaps 7.

Due to tolerances during the manufacturing process of the multi-layered gas discharge tube a first gap may occur during the discs 5 and the tube body 1. A second gap may occur between one of the inner electrodes 31, 32 and the tube body 1. If the first and second gap are formed so that they provide a path between one of the inner electrodes and one of the outer electrodes, this path may cause that, in case of an electric discharge, the discharge can be effected at the rim of one of the discs 5 and the tube body 1 from one of the inner electrodes 31, 32 to one of the outer electrodes 41, 42.

According to the embodiment of the multi-layered gas discharge tube as illustrated in FIG. 1, the tube body 1 includes a plurality of noses 21, 22, 23 extending differentially far into the interior of the tube body. The projections of the inner wall 11 of the tube body 1 enable that the isolated ceramic discs 51 and 52 may be positioned such that the discs are displaced in relation to the inner electrodes 31, 32 and the outer electrodes 41, 42. In particular, the respective rim of spacer discs 51, 52 is shifted in relation to the respective rim of the inner electrodes 31, 32. Thus, the appearance of a gap extending between the tube body and the inner electrodes 31, 32 and the discs 51, 52 from the inner electrodes 31, 32 towards the outer electrodes 41 and 42 can be omitted. The discs 51, 52 block a path extending at the border of the inner electrodes 31, 32 so that, in case of an electric discharge, the discharge will only take place in the center of the multi-step tube 1 and not at the border of the isolated ceramic discs.

Figure 2:
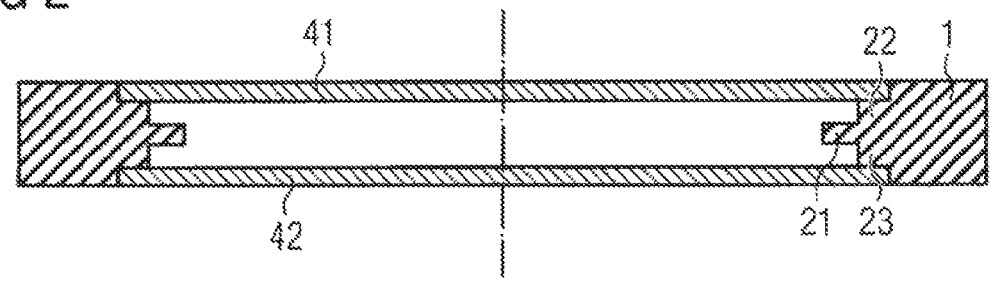
FIG. 2 shows a schematic structural view of an embodiment of a multi-step ceramic tube.

FIG. 2 illustrates an embodiment of a multi-step tube 1 comprising an inner wall with a plurality of protrusions. The protrusions extend differentially far inside the tube so that steps 21, 22 and 23 are formed. Each step has a surface formed to support a metal plate, such as the electrode discs shown in FIG. 1.

In a protection device made in accordance with the present invention, connection of the multi-layered discharge tubes in series can improve arc voltage, thereby extinguishing the follow current. The protection device comprises n gas discharge tubes that are welded together by brazing at 850 degrees. Each gas discharge tube has three discharge gaps therein, the arc voltage thereof is about 65V, and the total arc voltage of the protection device is n times of 65V.

LIST OF REFERENCE SIGNS

1 multi-step tube
2 step
3 inner electrode
4 outer electrode
5 disc
6 chamber
7 layer of discharge gap
21, 22, 23 steps
31, 32 inner electrodes
41, 42 outer electrodes
51, 52 discs
61, 62, 63 chambers

The invention claimed is:

1. A multi-layered gas discharge tube comprising:
a multi-step tube comprising:
a tube body of a ceramic material having an inner wall located inside the tube body;
a surface of the inner wall being formed with a plurality of steps, the steps being formed to extend differently far inside the tube body, wherein the steps of the tube body comprise a first step, a second step and a third step, the first step being arranged between the second step and the third step, and the first step extending further inside the tube body than the second step and the third step; and
an outer wall and outer surfaces of the tube body, each of the outer surfaces being located between the outer and the inner wall of the tube body, the outer surfaces having a larger area than a surface of each of the steps;
a first inner electrode being disposed on a first side of the first step inside of the tube body;
a second outer electrode being disposed on a first one of the outer surfaces outside of the tube body; and
a first isolated ceramic disc being disposed between the first inner electrode and the second outer electrode.

2. The multi-layered gas discharge tube as claimed in claim 1, wherein the first isolated ceramic disc is disposed partially on the first inner electrode and on the second step of the tube body.

3. The multi-layered gas discharge tube as claimed in claim 1, wherein the first inner electrode, the first isolated ceramic disc and the second outer electrode form a first chamber.

4. The multi-layered gas discharge tube as claimed in claim 1, comprising:
a third electrode being disposed on a second side of the first step of the tube body, and
the first and third electrodes and the tube body forming a second chamber.

5. The multi-layered gas discharge tube as claimed in claim 4, comprising:
a fourth electrode disposed on a second one of the outer surfaces of the tube body; and
the third and fourth electrodes and the tube body forming a third chamber.

6. The multi-layered gas discharge tube as claimed in claim 5, wherein each of the first, second and third chamber is filled with a mixture of inert and non-inert gases.

7. The multi-layered gas discharge tube as claimed in 5 or 6, wherein each of the first, second and third chamber form a layer of a discharge gap.

8. The multi-layered gas discharge tube as claimed in claim 4, wherein the multi-step tube and the isolated ceramic discs are designed in such a way, that regardless of the tolerances and position of the first and third electrodes and the first and second isolated ceramic discs it is assured that, in case of an electric discharge, the discharge will only take place in the center of the multi-step tube and not at the border of the isolated ceramic discs.

9. The multi-layered gas discharge tube as claimed in claim 1, wherein the multi-layered gas discharge tube comprises three layers of discharge gaps.

* * * * *